US011837820B2

(12) United States Patent
Brown et al.

(10) Patent No.: US 11,837,820 B2
(45) Date of Patent: Dec. 5, 2023

(54) CLIPPABLE INTERCONNECTION MODULE AND ASSOCIATED CONNECTION CORD

(71) Applicant: NEXANS, Courbevoie (FR)

(72) Inventors: Alan Brown, Tadley (GB); Rahul Rathod, Karnataka (IN); John Maddocks, Basingstoke (GB); Colin Statham, Basingstoke (GB); Martin Rossbach, Aachen (DE)

(73) Assignee: NEXANS, Courbevoie (FR)

( * ) Notice: Subject to any disclaimer, the term of this patent is extended or adjusted under 35 U.S.C. 154(b) by 68 days.

(21) Appl. No.: 17/630,502

(22) PCT Filed: Jul. 2, 2020

(86) PCT No.: PCT/EP2020/068608
§ 371 (c)(1),
(2) Date: Jan. 26, 2022

(87) PCT Pub. No.: WO2021/018506
PCT Pub. Date: Feb. 4, 2021

(65) Prior Publication Data

US 2022/0320795 A1 Oct. 6, 2022

(30) Foreign Application Priority Data

Jul. 31, 2019 (EP) ..... 19305990

(51) Int. Cl.
*H01R 13/627* (2006.01)
*H01R 13/24* (2006.01)

(52) U.S. Cl.
CPC ..... *H01R 13/6272* (2013.01); *H01R 13/24* (2013.01)

(58) Field of Classification Search
CPC ..... H01R 13/6272; H01R 13/627; H01R 3/00
USPC ..... 439/488–490; 340/686.1, 687
See application file for complete search history.

(56) References Cited

U.S. PATENT DOCUMENTS 5,097,100 A * 3/1992 Jackson ..... H01R 4/029 219/56.22
6,000,977 A * 12/1999 Haake ..... H01R 13/02 439/567
6,039,589 A 3/2000 Lalange et al.
6,574,586 B1 * 6/2003 David ..... H04M 3/22 702/183
6,725,177 B2 * 4/2004 David ..... H01R 13/7038 702/183
7,160,143 B2 * 1/2007 David ..... H04M 3/22 439/495
7,370,106 B2 * 5/2008 Caveney ..... H04Q 1/136 709/224
8,142,221 B2 * 3/2012 Malstron ..... H01R 24/64 439/489

(Continued)

OTHER PUBLICATIONS

International Search Report dated Aug. 24, 2020.

*Primary Examiner* — Gary F Paumen
(74) *Attorney, Agent, or Firm* — Sofer & Haroun, LLP

(57) ABSTRACT

This interconnection module (10) between a connection cord and a connection panel comprises a pair of spring-loaded conductive pins (12) and a molded body (14) in which a portion of said pair of pins (12) is embedded. At least one of the ends (121, 122) of each pin (12) projects from the body (14) and the body (14) forms a hollow volume making the module (10) clippable.

7 Claims, 4 Drawing Sheets

(56) References Cited

U.S. PATENT DOCUMENTS

| | | | | |
|---|---|---|---|---|
| 9,196,999 | B2 * | 11/2015 | Shifris | H04Q 1/136 |
| 2002/0090858 | A1 | 7/2002 | Caveney | |
| 2011/0256768 | A1 | 10/2011 | Malstrom et al. | |
| 2013/0095694 | A1 | 4/2013 | Shifris et al. | |

* cited by examiner

CLIPPABLE INTERCONNECTION MODULE AND ASSOCIATED CONNECTION CORD

RELATED APPLICATION

This application is a National Phase of PCT/FR2020/051032 filed on Jun. 16, 2020, which claims the benefit of priority from French Patent Application No. 19 07918, filed on Jul. 15, 2019, the entirety of which are incorporated by reference.

FIELD OF THE INVENTION

The present invention relates to an interconnection module that is clippable onto a connection cord, as well as to an associated connection cord and to an assembly comprising a connection panel and such a connection cord.

The invention belongs to the field of electrical connection devices.

DESCRIPTION OF RELATED ART

Connection cords equipped with spring-loaded conductive pins are often designed and manufactured specifically for a given application.

Besides, they often use a specific connection cable and a triaxial switch.

These known connection devices have in particular the drawbacks of being very expensive and not able to be replaced by standard connection cords.

OBJECTS AND SUMMARY

The object of the present invention is to remedy the above-mentioned drawbacks of the prior art.

To that end, the invention provides an interconnection module between a connection cord and a connection panel, remarkable in that it comprises a pair of spring-loaded conductive pins and a molded body in which a portion of the pair of pins is embedded, at least one of the ends of each pin projecting from the body and the body forming a hollow volume making the module clippable.

Thus, not only is the cost of such an interconnection module reduced, but in addition, that module can be clipped onto standard connection cords, without it being necessary to design and manufacture a connection cord specifically dedicated to a given application.

In a first particular embodiment, the pins of the pair of pins are connected to each other by a bridge welded on each pin, the bridge being embedded in the body. In a second particular embodiment, the pins of the pair of pins are connected to each other through a compression contact force applied by an electrical contact component arranged around the pins, the component being embedded in the body.

The connection between the two pins is thus protected against degradation from the outside.

In a particular embodiment, the body comprises a first face in which the portion of the pair of pins is embedded, two lateral opposed faces orthogonal to the first face and two flanges opposed to the first face, each of the flanges having a notch, the two notches facing each other and being symmetrical with respect to each other.

These notches make it possible to maintain the interconnection module in position once it is clipped on a connection cord.

In a particular embodiment, the body is made of plastic.

Such material is particularly suitable for molding, for example injection molding.

The present invention also provides a connection cord comprising at one end a latch and a latch protecting means arranged around the latch, the connection cord being remarkable in that the above-mentioned end of the connection cord is equipped with an interconnection module as succinctly described above, the interconnection module being clipped on the above-mentioned end.

In a particular embodiment of the connection cord, wherein the above-mentioned end is equipped with an interconnection module having notches as succinctly described above, the notches rest against the latch protecting means.

The present invention further provides an assembly comprising, on one hand, a connection panel having at least one input terminal and on the other hand, at least one connection cord as succinctly described above connected to the at least one input terminal, the assembly being remarkable in that the connection panel comprises a pair of connection pads corresponding to the input terminal and in that the pair of pins is in contact with the pair of connection pads.

In a particular embodiment, the connection pads are made of a material comprising gold.

Namely, gold has very good electrical conductivity and therefore creates high-quality connections.

The particular features and advantages of the connection cord and of the assembly being similar to those of the interconnection module, they are not repeated here.

BRIEF DESCRIPTION OF THE DRAWINGS

Other aspects and advantages of the invention will become apparent from the detailed description of particular embodiments given below by way of non-limiting examples, with reference to the accompanying drawings, in which.

DETAILED DESCRIPTION

Figure 1:
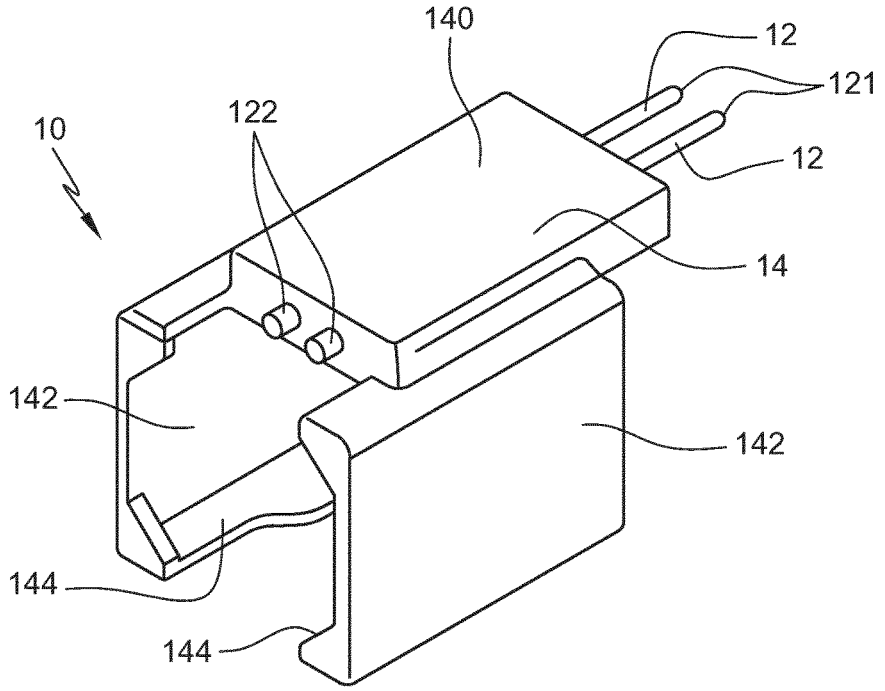
FIG. 1 is a schematic view in perspective of an interconnection module according to the present invention, in a particular embodiment.

As shown in FIG. 1, an interconnection module according to the present invention comprises a pair of spring-loaded conductive pins 12 and a body 14.

The body 14 is molded on the spring-loaded conductive pins 12 in such a manner that only a portion of the pins 12 is embedded in the body 14. Namely, at least one end 121 among the two ends 121 and 122 of each pin 12 projects from the body 14. In a particular embodiment where the body 14 is made of plastic, it may be molded for example by injection molding.

The body 14 forms a hollow volume, like a sheath or case, which makes the interconnection module 10 clippable onto a connection cord, as will be described in detail hereafter. In other words, the body 14 forms a hollow volume making the module 10 clippable so that it is removable for use in another plug assembly.

Figure 2:
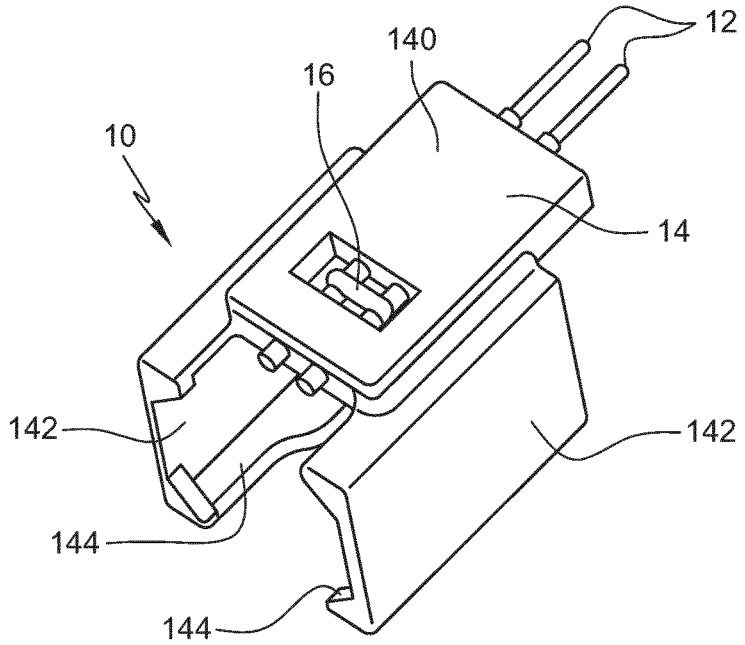
FIG. 2 is a schematic view in perspective of the interconnection module of FIG. 1 where material has been removed in order to show the bridge connecting the two spring-loaded conductive pins with each other in a first embodiment.

As shown in FIG. 2, in a first particular embodiment, inside the embedding formed by the molded body 14, the spring-loaded conductive pins 12 are connected to each other by a bridge 16 welded on each pin 12.

Figure 7:
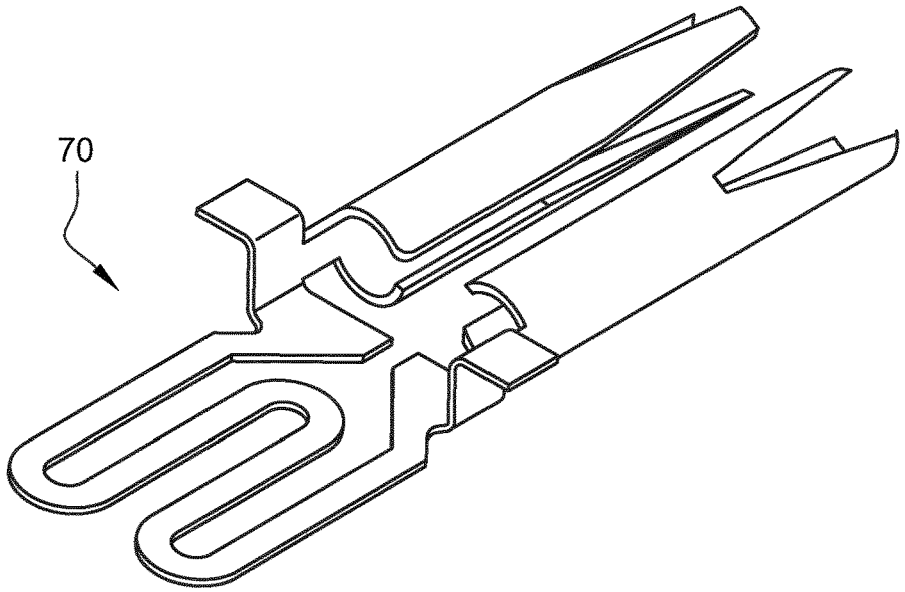
FIGS. 7 and 8 are schematic views in perspective of a second embodiment of the connection between the two spring-loaded conductive pins.
Figure 8:
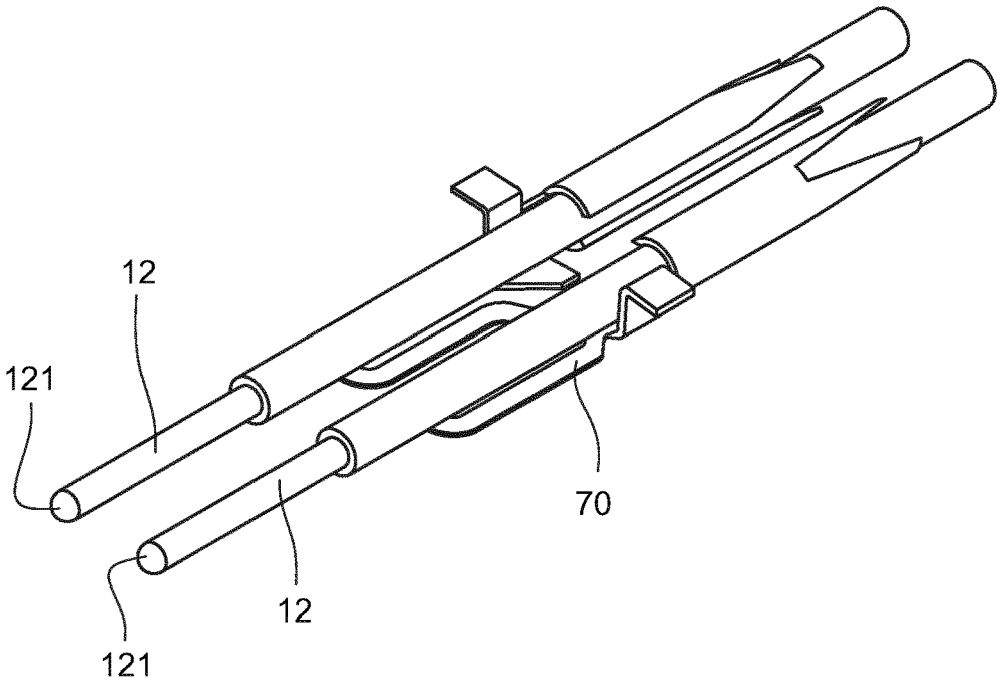

FIGS. 7 and 8 show a second embodiment of the connection between the two spring-loaded conductive pins 12. In that second embodiment, the bridge 16 is replaced by an electrical contact bridge component 70 arranged around both pins 12 and applying a compression contact force on the pins 12 to connect the pins 12 with each other. The component 70 is made of a conductive material, thus making electrical connection between the pins 12. This sub-assembly (pins 12 and component 70) is over-molded by the body 14 in the same way as the welded bridge 16 of the first embodiment.

FIG. 7 shows the component 70 separately and FIG. 8 shows the component 70 arranged around the pins 12.

FIGS. 1 and 2 show that the body 14 comprises a first face 140 in which the pair of spring-loaded conductive pins 12 is partially embedded and two lateral opposed faces 142 orthogonal to the first face 140. The body 14 further comprises two flanges 144 opposed to the first face 140. Each flange 144 projects orthogonally from a respective lateral face 142, toward the inside of the body 14.

Figure 5:
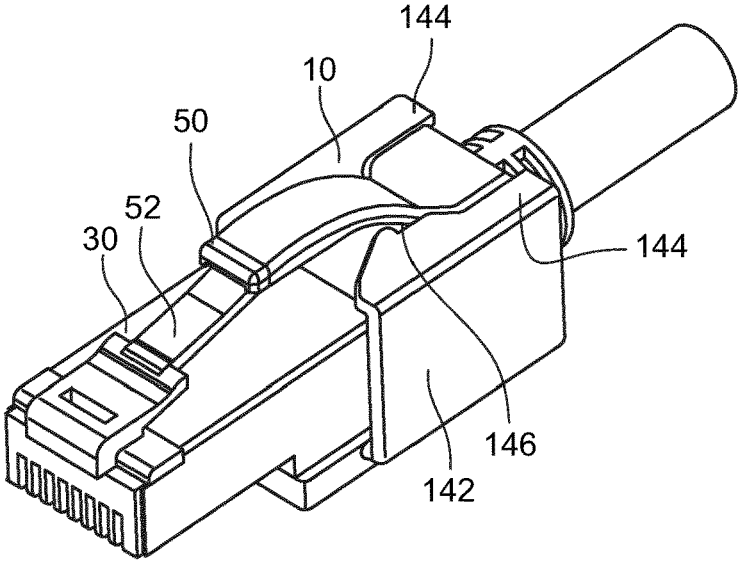
FIG. 5 is a schematic bottom view in perspective of the connection cord of FIG. 4, showing how the interconnection module is maintained in position.

As better shown on the bottom view of FIG. 5, each of the two flanges 144 has a notch 146 that makes it possible to maintain the interconnection module 10 in position once it is clipped on the end of a connection cord 30. The two notches 146 face each other and are symmetrical with respect to one another, pursuant to an axial symmetry with respect to the longitudinal axis of symmetry of the connection cord 30.

Figure 3:
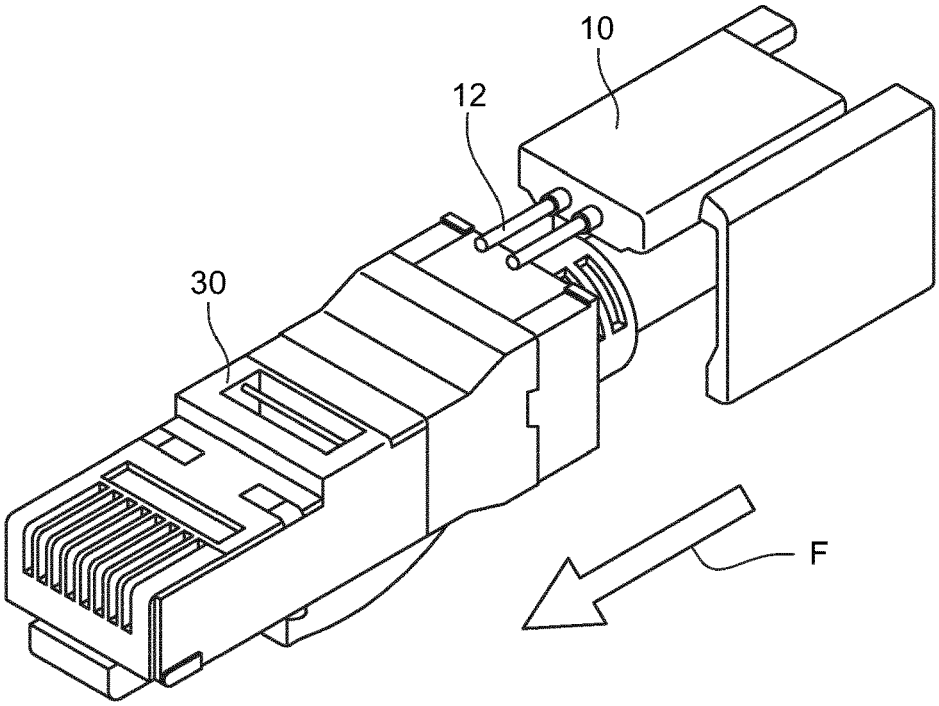
FIG. 3 is a schematic view in perspective of the interconnection module of FIG. 1 in the course of being assembled onto a connection cord according to the present invention, in a particular embodiment.
Figure 4:
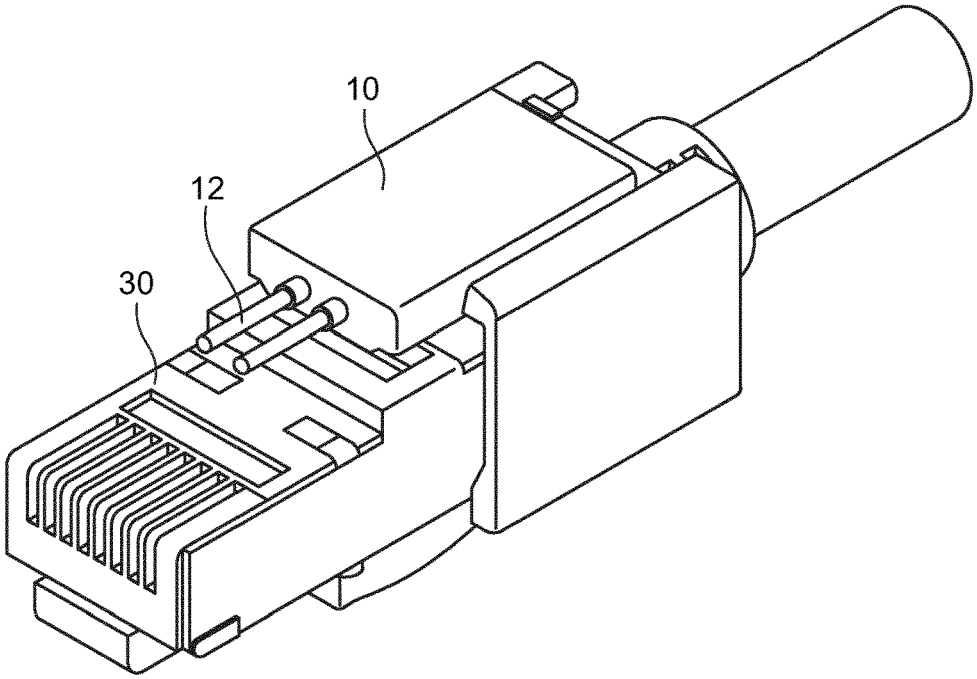
FIG. 4 is a schematic view in perspective of a connection cord according to the present invention equipped with an interconnection module according to the present invention, in a particular embodiment.

FIGS. 3, 4 and 5 show the manner in which the interconnection module 10 according to the invention is assembled by clipping on the end of a connection cord 30.

In FIG. 3, the arrow F indicates that the interconnection module 10, once placed around the connection cord 30, is pushed toward the end of the connection cord 30, until the notches 146 are located below a means 50 of protection of a latch 52 of the connection cord 30, such arrangement being shown in FIG. 5. The notches 146 then rest against the protecting means 50, which prevents the interconnection module 10 from slipping away from the end of the connection cord 30 (in a direction opposite to the arrow F).

Figure 6:
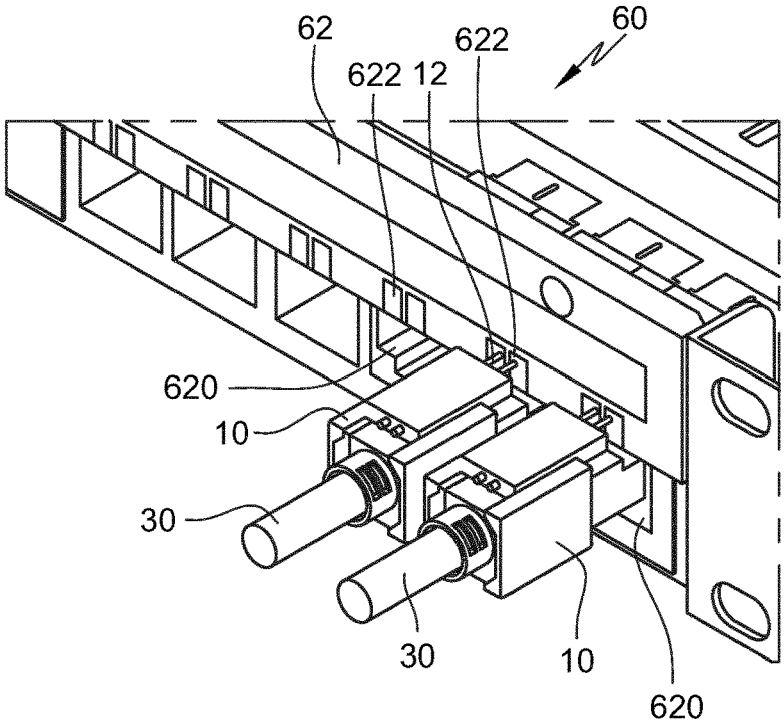
FIG. 6 is a schematic view in perspective of an assembly according to the present invention comprising two connection cords according to the present invention and a connection panel.

The latch 52 is provided on the end of the connection cord 30 adapted to be plugged in an input terminal 620 of an electrical device such as a connection panel 60 of the type illustrated in FIG. 6. The latch 52 makes it possible for the connection cord 30 to stay in position in the input terminal 620 after it is plugged therein.

The latch protecting means 50 is arranged around the latch 52, for example by molding.

FIG. 6 shows an assembly 60 that comprises a connection panel 62 having at least one input terminal 620. In the illustrated non-limiting example, there are six input terminals.

The assembly 60 further comprises at least one connection cord such as the one described above, which is plugged in the at least one input terminal 620. In the illustrated non-limiting example, two connection cords 30 are plugged in two adjacent input terminals 620, respectively.

According to the invention, the connection panel 62 comprises a pair of connection pads 622 corresponding to an input terminal 620, each pin of the pair of spring-loaded conductive pins 12 of an interconnection module 10 being in contact with a pad of the pair of connection pads 622. In the illustrated example, each of the two connection cords 30 is connected to the connection panel 62 through a pair of connection pads 622 located on the connection panel 62 above the plugging port of the respective input terminal 620.

The connection pads 622 are made of a conductive material, for example comprising gold.

Thus, when the connection cord 30 is inserted into one of the input terminals 620 of the connection panel 62, the pins of the pair of spring-loaded conductive pins 12 automatically make electrical and mechanical contact with the pads of the pair of connection pads 622.

The invention claimed is:

1. An interconnection module between a connection cord and a connection panel, said interconnection module comprising:

a pair of spring-loaded conductive pins; and a molded body in which a portion of said pair of pins is embedded, at least one of the ends of each pin projecting from said body and said body forming a hollow volume making said module clippable, wherein said body comprises a first face in which said portion of said pair of pins is embedded, two laterally opposed faces orthogonal to said first face and two flanges opposed to said first face, each of said flanges having a notch, the two notches facing each other and being symmetrical with respect to each other.

2. The interconnection module according to claim 1, wherein the pins of said pair of pins are connected to each other by a bridge welded on each pin, said bridge being embedded in said body.

3. The interconnection module according to claim 1, wherein the pins of said pair of pins are connected to each other through a compression contact force applied by an electrical contact component arranged around the pins, said component being embedded in said body.

4. The interconnection module according to claim 1, wherein said body is made of plastic.

5. A connection cord comprising:

at one end a latch; and a latch protecting means arranged around said latch, wherein said end of said connection cord is equipped with an interconnection module, said interconnection module having:

a pair of spring-loaded conductive pins; and a molded body in which a portion of said pair of pins is embedded, at least one of the ends of each pin projecting from said body and said body forming a hollow volume making said module clippable, said interconnection module being clipped on said end, wherein said end is equipped with an interconnection module, having a pair of spring-loaded conductive pins; and a molded body in which a portion of said pair of pins is embedded, at least one of the ends of each pin projecting from said body and said body forming, a hollow volume making said module clippable, wherein said body has a first face in which said portion of said pair of pins is embedded, two laterally opposed faces orthogonal to said first face and two flanges opposed to said first face, each of said flanges having a notch, the two notches facing each other and being symmetrical with respect to each other, wherein said notches rest against said latch protecting means.

6. An assembly comprising;

on one hand, a connection panel having at least one input terminal; and on the other hand, at least one connection cord according to claim 5 connected to said at least one input terminal;

wherein said connection panel comprises a pair of connection pads corresponding to said input terminal and in that said pair of pins is in contact with said pair of connection pads.

7. The assembly according to claim 6, wherein said connection pads are made of a material comprising gold.

* * * * *